US009036859B2

(12) United States Patent
Kristiansen et al.

(10) Patent No.: US 9,036,859 B2
(45) Date of Patent: May 19, 2015

(54) ELECTROMAGNETIC DRIVE UNIT

(75) Inventors: Kim Kristiansen, Silkeborg (DK); Flemming Buus Bendixen, Hobro (DK); Troels Bogsted Brøndbjerg, Viborg (DK)

(73) Assignee: DALI A/S, Norager (DK)

( * ) Notice: Subject to any disclaimer, the term of this patent is extended or adjusted under 35 U.S.C. 154(b) by 0 days.

(21) Appl. No.: 14/115,444

(22) PCT Filed: May 3, 2012

(86) PCT No.: PCT/DK2012/050146

§ 371 (c)(1),
(2), (4) Date: Feb. 10, 2014

(87) PCT Pub. No.: WO2012/149938

PCT Pub. Date: Nov. 8, 2012

(65) Prior Publication Data

US 2014/0169615 A1 Jun. 19, 2014

(30) Foreign Application Priority Data

May 4, 2011 (DK) ..... 2011 00340

(51) Int. Cl.
*H04R 25/00* (2006.01)
*H04R 1/00* (2006.01)
*H04R 9/02* (2006.01)

(52) U.S. Cl.
CPC ..... *H04R 1/00* (2013.01); *H04R 9/025* (2013.01); *H04R 2209/021* (2013.01)

(58) Field of Classification Search
CPC ..... H04R 1/00; H04R 2209/021; H04R 2209/022; H04R 9/02; H04R 9/06; H04R 9/025
USPC ..... 381/396, 412, 414, 420, 421, 422; 335/222, 231, 296, 302, 306
See application file for complete search history.

(56) References Cited

U.S. PATENT DOCUMENTS

| | | | | |
|---|---|---|---|---|
| 3,783,311 | A * | 1/1974 | Sato et al. | 310/27 |
| 4,289,937 | A * | 9/1981 | Ikeda et al. | 381/414 |
| 2011/0150264 | A1* | 6/2011 | Konuma | 381/398 |

FOREIGN PATENT DOCUMENTS

| | | | |
|---|---|---|---|
| DE | 3108715 | | 9/1982 |
| DE | 3108715 | A1 | 9/1982 |
| JP | 56 128099 | A | 10/1981 |
| JP | S56-128099 | | 10/1981 |
| WO | WO 2008/069749 | A2 | 6/2008 |

OTHER PUBLICATIONS

International Search Report prepared by the European Patent Office on Jul. 9, 2012, for International Application No. PCT/DK2012/050146.
Written Opinion for International (PCT) Patent Application No. PCT/DK2012/050146 mailed Jul. 9, 2012, 4 pages.
International Preliminary Report on Patentability for International (PCT) Patent Application No. PCT/DK2012/050146 dated Nov. 5, 2013, 6 pages.

* cited by examiner

*Primary Examiner* — Huyen D Le
(74) *Attorney, Agent, or Firm* — Sheridan Ross P.C.

(57) ABSTRACT

An electromagnetic drive unit for a loudspeaker of the type where an air gap is arranged in a magnet system such that magnetic flux lines are substantially linear across the air gap, and that a voice coil is arranged in said air gap, wherein the magnet system comprises a central yoke separated by said air gap from a ring-shaped magnet system, which magnet system at least comprises a bottom plate connected to said central yoke, and a magnet and a top plate, characterized in that at least a section of the central yoke corresponding to the extent of the air gap and at least a corresponding section of the top plate is made from a soft magnetic composite material.

4 Claims, 1 Drawing Sheet

ELECTROMAGNETIC DRIVE UNIT

CROSS REFERENCE TO RELATED APPLICATIONS

This application is a national stage application under 35 U.S.C. 371 of PCT Application No. PCT/DK2012/050146 having an international filing date of 3 May 2012, which designated the United States, which PCT application claimed the benefit of Denmark Patent Application No. PA201100340 filed 4 May 2011, the entire disclosure of each of which is incorporated herein by reference.

FIELD OF THE INVENTION

The present invention relates to a magnet assembly for a transducer unit of the type having a moving membrane and having a voice coil arranged in an air gap in said magnet assembly.

The present invention furthermore relates to a loudspeaker comprising a magnet assembly according to the invention, as well as a loudspeaker cabinet comprising such a loudspeaker.

BACKGROUND OF THE INVENTION

In the art a number of different solutions to the construction of the magnet system have been suggested. When using magnet systems as drivers for generating the sound by moving the membrane it is customary to arrange a gap between two parts of the magnet system so that there will be a magnetic flux field arranged across this gap. In the gap is arranged a voice coil. The voice coil will move in the flux field in response to an alternating current induced in the coil. The magnetic flux field of the magnet will force the coil to move in the magnetic flux field substantially perpendicular to the direction of the flux lines making up the flux field and perpendicular to the direction of the current. The alternating current in the voice coil will when the voice coil is attached to a membrane generate the sound stemming from a loudspeaker.

In the art there are generally two types of magnet assembly designs, the first being overhung where a relatively wide voice coil is arranged in a relatively narrow gap in such a way that the actual extension of the coil exceeds the actual extension of the gap. The other principle commonly applied is a so-called underhung system where a relatively narrow coil is arranged in a relatively wide gap in such a way that the actual extension of the gap exceeds the actual extension of the voice coil.

The present invention is suitable with both types of designs as well as a neutral hung design, i.e. a design where the voice coil and the gap are of the same dimensions.

An example of a prior art loudspeaker assembly is disclosed in US 2002/0106101. This system comprises a driver unit comprising a central T-yoke around which a permanent magnet is arranged. The construction provides a gap in which the voice coil may move almost at the periphery of the driver. Furthermore, in order to save construction height, the driver is partly arranged in front of the loudspeaker membrane, which will give rise to sound distortion and a rather complicated design with respect to fastening of the driver to the chassis.

A further example of prior art design is known from WO 98/47312 wherein a magnet system is arranged in connection with a yoke construction. The gap in which the voice coil travels is arranged in the traditional manner as discussed above. Therefore, this construction also experiences problems resulting in distortion due to magnetic flux roll-off in either end (upper and lower) of the gap due to magnetic flux concentration in these areas. Where the difference in active cross-sectional area between the magnet and the gap is large, roll-off effects will be created.

Another prior art design is illustrated in DE 3108715. In this magnet assembly the magnet is particular in that the magnet surrounding the air gap is made from a composite material comprising iron powder with an artificial binder, typically based on a polymer. The purpose of using a composite conductive material is to minimize the eddy currents which will arise as the voice coil moves in the air gap due to the changes in the currents in the voice coil and the magnetic poles.

In general, it is desirable to obtain as linear a magnetic field across the air gap as possible in order to avoid distortion of the produced sound. The eddy currents will create distortion, and as such it is a desire to create a magnetic flux in the air gap which is substantially free of eddy currents.

This problem has also been addressed in JP 56-128099 and JP 59-21199 wherein iron powder has been sintered under pressure and high temperature, (approximately 1200° C.), in order to create a non-conductive material which in the above mentioned Japanese publications are arranged on either side of the air gap in order to minimize the effect of eddy currents. Although the resulting magnetic assembly is improved over the prior art and does reduce distortion, they still do not provide an optimum sound reproduction in that the effect of the eddy currents has a direct effect on the harmonic capabilities of the loudspeaker. The sintering process is made by using iron powder which together with the phosphor additive during the sintering process is melted together creating a relatively hard material which has an electrical conductivity approximately ten times less than that of normal iron. As such the magnetic conductivity is maintained whereas the electrical conductivity creating the eddy currents has been decreased whereby also the effect of the eddy currents is decreased.

OBJECT OF THE INVENTION

It is therefore a purpose of the present invention to provide a magnetic assembly for use in a loudspeaker where the distortion is minimized substantially in comparison to the prior art.

A prerequisite for an accurate sound reproduction in a loudspeaker is that the sound waves produced by the moving membrane of the loudspeaker are as far as possible a true representation of the electrical voltage supplied to the loudspeaker. A wide range of parameters influence the accuracy of the wave form of the produced sound waves. One important parameter which has a great influence on the degree of the accuracy of the produced sound is the degree of linearity between the electrical signal supplied to the loudspeaker and the actual movement of the membrane.

Parameters influencing the accuracy in this movement of the membrane are at least two-fold. In order to obtain a high-fidelity response by the membrane on the supplied electrical signal the actual movement of the membrane should respond linearly to the electrical signal. In order to achieve such a linear response of the membrane the magnetic flux in the gap in which the coil is accommodated must be as homogenous as possible. The more homogenous flux the less distortion will result.

In addition, as already mentioned above it is important that the roll-off strength of the B-field is as symmetrical as possible in that the curve representing the B-field as a function of the distance from the centre of the gap should exhibit similar characteristics in either actual direction from the centre of the gap. Hence, the curve representing the B-field as a function of the distance from the centre of the gap should as far as possible be symmetrical around the centre of the gap at distances falling within the gap as well as distances falling just outside the gap. In this way the so-called even harmonic distortion can be reduced. Furthermore, having a symmetrical roll-off strength of the B-field outside the gap implies that the coil may partly leave the gap without causing any unacceptable distortion. In other words, the less eddy currents present in the magnetic flux field between the conductive members surrounding the air gap, the better the linearity of the flux field is, and therefore the better the voice coil will respond in a linear fashion across the entire air gap and thereby in the loudspeaker's range.

It is therefore an object of the present invention to provide a magnet assembly of the type having a moving membrane connected to a voice coil which voice coil is movable in an air gap in a magnet assembly wherein the performance of the magnet assembly is improved. The improvement is mainly directed at creating a homogenous magnetic flux in the gap intended for the accommodation of the voice coil and providing a magnet system which even after extended continuous use has less distortion of the sound, even at the very limits of the voice coil's movement.

DESCRIPTION OF THE INVENTION

This object is achieved by the present invention by an electromagnetic drive unit for a loudspeaker of the type where an air gap is arranged in a magnet system such that magnetic flux lines are substantially linear across the air gap, and that a voice coil is arranged in said air gap, wherein the magnet system comprises a central yoke separated by said air gap from a ring-shaped magnet system, which magnet system at least comprises a bottom plate connected to said central yoke, and a magnet and a top plate, characterised in that at least a section of the central yoke corresponding to the extent of the air gap and at least a corresponding section of the top plate is made from a soft magnetic composite material.

Especially the use of soft magnetic composite material (SMC) provides for an extremely low generation of eddy currents in the gap. As these materials are typically more expensive than traditional iron material used for electromagnetic drive units, it is advantageous only to arrange the soft magnetic composite material (SMC) where eddy currents may influence the voice coil.

SMC is an isotropic iron-based material with a very low electrical conductivity, but with very high magnetic permeability and high saturation induction. With these properties the flux saturation is very high whereby the resulting magnetic flux becomes more even and consistent.

TABLE 1 relative comparison of relevant parameters.

| Type | Saturation level | Conductivity | Mechanical strength/ characteristics |
|---|---|---|---|
| Ordinary iron | Approx. 2.1 T | 0.097 μΩm | High |
| NiFe alloy | Approx. 1.6 T | 0.5 μΩm | high |
| Ironpowder sintered | Approx. 2 T | 0.1-0.5 μΩm | high |
| Ferrite MnFeO sintered | 0.4-0.5 T | 5.000.000 μΩm | brittle |
| Polymer adhered ironpowder | 1.9-2.1 T | 280-800 μΩm | Low (temperature dependent) |
| SMC ceramically bound | 1.9-2.1 T | 75-10.000 μΩm | medium |

For loudspeaker drivers of the electromagnetic drive unit type as described above it is important to have a high magnetic conductivity, but as small as possible electrically conductive characteristics. The electrically conductive materials will facilitate the creation of eddy currents and thereby the distortion already mentioned above. The SMC material is a poor electrical conductor whereas due to its relatively high iron content it has very good magnetic conductance. In comparison the electrical resistance, see also table 1, of for example pure iron is approximately 0.097 microΩmetre, for a sintered iron powder material the corresponding resistance is 1.0 microΩmetre whereas for SMC materials they have a resistance of approximately 400-8,000 microΩmetre depending on the composition of the soft magnetic composite. Consequently, using an SMC material in order to create a flux field the magnetic conductance is maintained whereas the electrical conductivity is a factor of approximately 10,000 less than that for traditional iron products whereby the creation of eddy currents is severely minimized. Therefore, the flux field in the air gap will be more homogenous such that increased linearity will be present.

Another factor influencing the performance over time of a flux field is the hysteresis magnetic property of the material which is discussed in for example GB 2022362. Due to its inherent construction with relatively poor electrical conductivity the SMC material will also have improved linearity relating to the hysteresis magnetic properties of the material.

In a further advantageous embodiment the soft magnetic composite material is iron powder having a particle size in the range 45 μm to 150 μm where the particles of the powder are coated with an electrically insulating inorganic compound.

The SMC material's characteristics depend on the composition of the SMC, i.e. the particle sizes, shapes, additives etc., but with the present invention it has been found that particles covered with an inorganic electrically insulating compound having a reduced air void content provides the advantages already mentioned above.

In a further advantageous embodiment the entire yoke and/or the entire top plate is made from the soft magnetic composite material.

The characteristics of the SMC material are such that it is possible to connect iron and SMC, for example by pressure (fuse them together) in such a manner that it is substantially indistinguishable where the limit is from one material to the other. Therefore, it is possible to produce raw blocks of composite materials forged with iron parts and thereafter work the pieces in to the desired shape.

The SMC material is distinguished from other materials by the fact that the iron powder particles are bound together in a ceramic sintering process, wherein an oxide layer is formed as the connecting boundary layer between the particles. As opposed to other materials where a polymer is used in order to connect/bind the particles together, a strong and rigid connection is provided. The polymer, although having very good electrically insulating properties is sensitive to temperature variations. In use the magnet system of a loudspeaker will heat up, whereby the polymer bound materials will become increasingly plastic and deformable. This will create distortion of the materials and thereby the sound generation.

The invention is also directed at a loudspeaker having at least one electromagnetic drive unit in a loudspeaker unit according to the description above.

DESCRIPTION OF THE DRAWING

The invention will now be explained with reference to the drawings wherein.

DETAILED DESCRIPTION OF THE INVENTION

Figure 1:
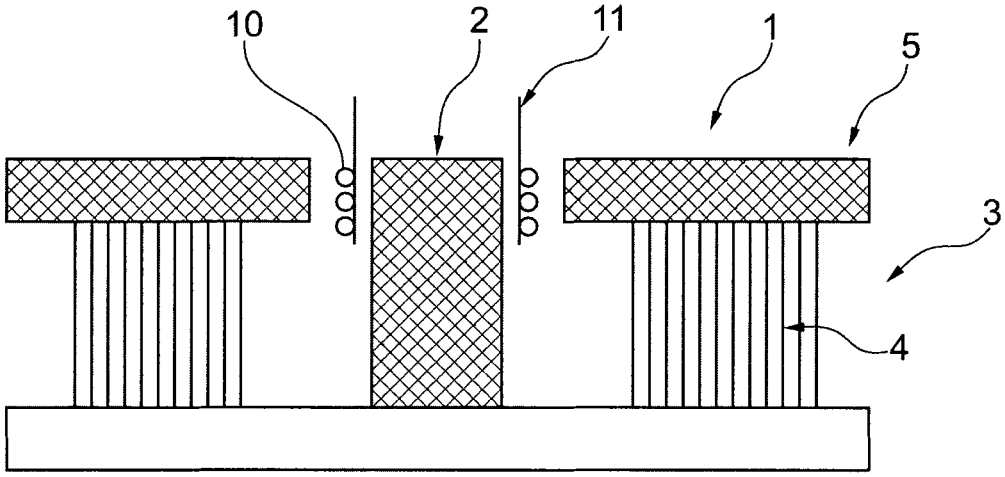
FIG. 1 illustrates an electro-magnetic drive unit according to the invention

In FIG. 1 is illustrated an electromagnetic drive unit for a loudspeaker where the electromagnetic drive unit 1 has a central yoke 2 and a ring-shaped magnet system 3. The magnet system 3 comprises a magnet 4 which is substantially circular or at least in sections are placed in a circle substantially equidistant from the central yoke, and on top of which magnet 4 is arranged a circular top plate 5, such that the relative dimensions between the inner diameter of the top plate 5 and the outer diameter of the central yoke 2 provides an air-gap 10 in which air gap a voice coil 11 is arranged. The top plate 5 as well as the central yoke 2 is in this embodiment made from a soft magnetic composite material (SMC) as discussed above where the electric conductivity is very low whereas the magnetic conductivity is very high.

Furthermore, it is possible to saturate the SMC more than what is possible with normal iron members and at the same time avoid eddy currents such that the magnetic flux field in the air gap 10 between the inner diameter of the top plate 5 and the outer diameter of the yoke 2 is substantially linear and is not influenced by any distortion deriving from the generation of eddy currents as could otherwise be the case when the voice coil 11 starts moving in the air gap 10.

The voice coil moves in response to an electrical current being induced in the coils whereby the coils will move in the magnetic flux field and thereby move a membrane (not illustrated) as part of the loudspeaker unit. The magnet 4 is a standard magnet, but may also be any type of high grade magnet, for example a neodyn magnet. The SMC material makes it easier to saturate the SMC with magnetic flux, and therefore the parts maybe smaller, or the magnets may be smaller in that the higher saturation provides for a more homogenous and linear flux field in the air-gap 10.

Figure 2:
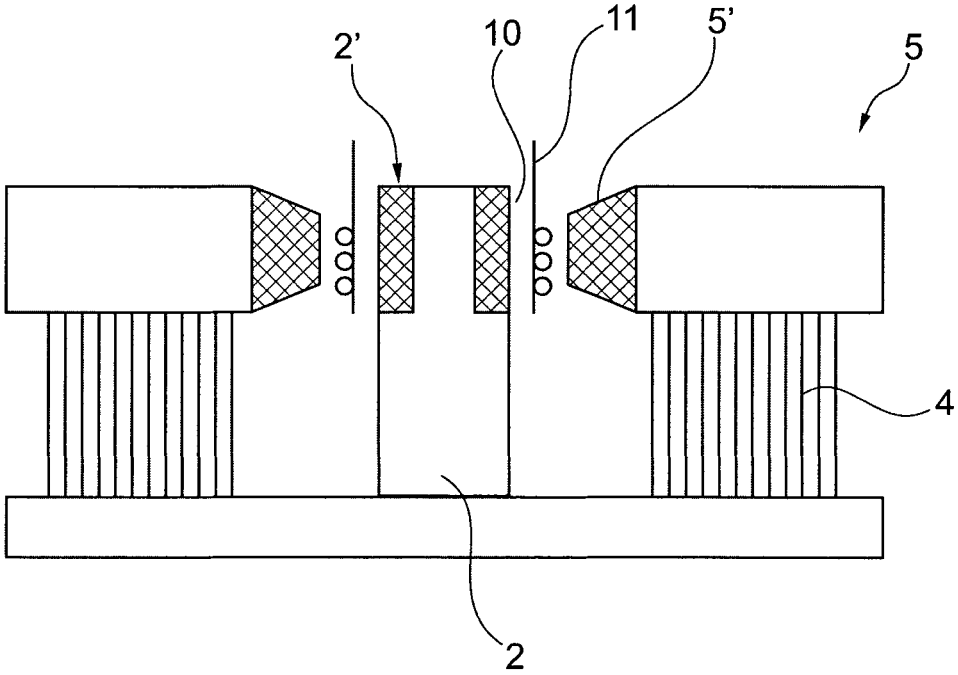
FIG. 2 illustrates a further embodiment of the invention where only certain parts are made from the SMC material

In FIG. 2 a further embodiment of the invention is illustrated where only certain parts 5' of the top ring are made from the SMC material. Likewise, only a limited portion 2' of the central yoke 2 is provided with SMC material. The construction illustrated in FIG. 2 will have the benefits of the magnetic conductivity of the SMC material and likewise the benefits of very low electrical conductivity such that also in this embodiment eddy currents will be negligible.

During the manufacturing process it is possible to fuse the SMC material together with the iron material, such that for example the top ring as illustrated in FIG. 2 will more or less be a homogenous material.

The top ring 5 and the magnet 4 may also be made as smaller units which are arranged adjacent each other in a circle such that the magnetic flux field between the yoke and the top ring 5 will be created in this manner. The embodiment is particularly advantageous in that it is possible in a more rational manner to manufacture the small sections in that the small sections may be given any cross section in a vertical section (in use) such that other effects may be obtained, as for example lower air resistance, better use of more expensive materials etc.

The invention claimed is:

1. An electromagnetic drive unit for a loudspeaker comprising:

a ring-shaped magnet system;

a central yoke separated from said magnet system by an air gap;

said ring-shaped magnet system having a bottom plate connected to said central yoke, a magnet, and a top plate;

said central yoke and said top plate each having a section corresponding to said air gap made from a soft magnetic composite material;

said soft magnetic composite material including iron powder particles bound together in a ceramic sintering process;

said soft magnetic composite material having an oxide layer formed during said ceramic sintering process as a connecting boundary layer between said iron powder particles;

a voice coil arranged in said air gap; and wherein magnetic flux lines produced are substantially linear across said air gap.

2. An electromagnetic drive unit according to claim 1 wherein the iron powder particles of said soft magnetic composite material have a particle size in a range 45 μm to 150 μm and the iron powder particles are coated with an electrically insulating inorganic compound.

3. A loudspeaker unit including a frame, a surround connecting the frame to a membrane, a voice coil integrated with said membrane, and further comprising:

an electromagnetic drive unit including a ring-shaped magnet system;

a central yoke separated from said magnet system by an air gap;

said ring-shaped magnet system having a bottom plate connected to said central yoke, a magnet, and a top plate;

said central yoke and said top plate each having a section corresponding to said air gap made from a soft magnetic composite material;

said soft magnetic composite material including iron powder particles bound together in a ceramic sintering process;

soft magnetic composite material having an oxide layer formed during said ceramic sintering process as a connecting boundary layer between said iron powder particles;

said voice coil is arranged in said gap of said electromagnetic drive unit; and wherein magnetic flux lines produced are substantially linear across said air gap.

4. A loudspeaker, according to claim 3, wherein the iron powder particles of the soft magnetic composite material have a particle size in a range 45 μm to 150 μm and the iron particles are coated with an electrically insulating inorganic compound.

* * * * *